United States Patent [19]

Spaccapaniccia

[11] 4,250,903

[45] Feb. 17, 1981

[54] SUPPORT FOR DRYING HAIR

[76] Inventor: Domenico Spaccapaniccia, (AP), Via XX Giugno, 16 Fermo, Italy

[21] Appl. No.: 35,319

[22] Filed: May 2, 1979

[30] Foreign Application Priority Data

May 16, 1978 [IT] Italy ..... 17912 A/78

[51] Int. Cl.[3] ..... A45D 1/00

[52] U.S. Cl. ..... 132/9; 132/40; D28/38

[58] Field of Search ..... 132/9, 31 R, 40, 42 R, 132/42 A, 46 R; D28/35, 37, 38, 39, 41; 248/230

[56] References Cited

U.S. PATENT DOCUMENTS

| | | | |
|---|---|---|---|
| 2,668,547 | 2/1954 | Wille | 132/46 |
| 2,818,870 | 1/1958 | Francis | 132/46 |
| 3,343,548 | 9/1967 | Morgan | 132/9 |

FOREIGN PATENT DOCUMENTS

| | | | |
|---|---|---|---|
| 1171573 | 6/1964 | Fed. Rep. of Germany | 132/40 |

*Primary Examiner*—Charles N. Hart
*Assistant Examiner*—David R. Sadowski
*Attorney, Agent, or Firm*—Blair, Brown & Kreten

[57] ABSTRACT

Disclosed herein is a support for hair to be used when drying and fashioning same comprising a plastic element in the form of a truncated cone which has been flattened along opposed sides and is provided with ventilation openings along the main body thereof. The top face of the cone is open and is provided with an irregular surface to serve as a nesting area for hair rollers disposed thereon, and a notch on the top edge thereof to provide nesting of a second hair fashioning element. The bottom edge of the cone may have a curvilinear surface to conform to the contour of a person's head if so desired.

2 Claims, 3 Drawing Figures

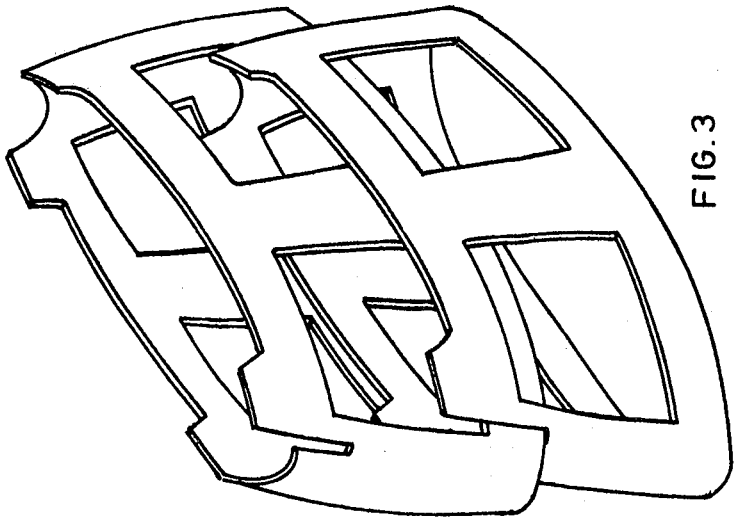
FIG. 3
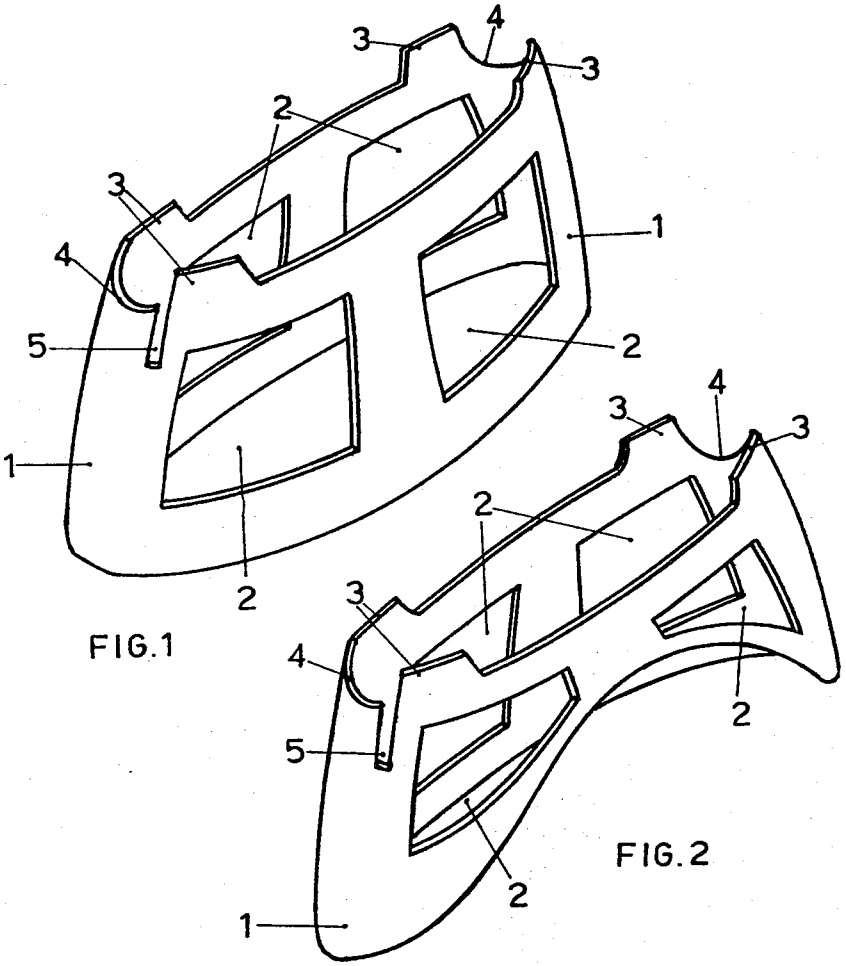
FIG. 1
FIG. 2

SUPPORT FOR DRYING HAIR

BACKGROUND & SUMMARY OF THE INVENTION

The subject of the invention consists of a support for hair rollers that permits the fixing of bunches of hair gripped in position by their ends.

This enables a drying to be attained in a very short time, under the drier hood, so that the hair, not being repeatedly twisted around the rollers, although stretched out over its entire length, can all be worked on directly by the hot flow of air coming from the drier hood.

Other than enabling a minimal drying time, a further object of the invention permits positioning the hair from the beginning, that is with wet hair, which is to be the final hair style, which, according to the current technique, must be often done with a hair brush and hand hair drier.

BRIEF DESCRIPTION OF THE DRAWINGS

FIG. 1 is a perspective view of the apparatus according to the present invention;

FIG. 2 is a similar perspective view in which the bottom edge thereof has a curved surface to conform to the contour of a person's head; and FIG. 3 shows the devices in stacked registry.

DESCRIPTION OF THE PREFERRED EMBODIMENT

With reference to FIG. 1, the support 1 is seen to be made of a plastic element having the form of the trunk of an upright cone which has been flattened so that horizontal transverse sections of the form appear to be concentric elongated ellipses.

The said element has around the sides a few ventilation holes 2, which are more or less rectangular in shape, and these ensure a continuous and uniform flow of hot air into the hair held tight and fixed on the inside of the support 1.

The end of each bunch of hair, in fact, after it has been threaded through the above mentioned element 1, is twisted for a small angle around a roller of adequate size which slots automatically into the top of the truncated cone support by the help of the tabs 3.

Should it be necessary, external gripping elements may be used such as hair clips, forks or similar.

In such a way, the element 1 is placed more or less towards the top, once positioned on the scalp, and two versions of this are foreseen which differ only in the arrangement of their lower edge.

The support, designed to be applied to the upper middle part of the head, has an lower edge which can be considered to be a closed curve of intersection between the sides of this support and that of a sphere whose diameter coincides with the axis of the truncated cone, whilst, in the case when it is necessary to work on the sides of the head, the supports are used on which the lower edge can still be considered to be the closed curve of intersection between a sphere and the truncated cone, but, in this case, its axis no longer coincides with any diameter although it is parallel to one of these and at a distance from it of about half the radius of the sphere.

The sphere referred to here, has the approximate dimensions of a person's head.

The differing job and application of these two types of support allows their use on any area of the scalp, and thus arrangement of the tight bunches of hair towards the top.

The transverse and longitudinal dimensions of the support are said to be of the size of just about those of a roller of medium size, such that this roller must be located and fixed at the top of the element 1.

In FIG. 1, the two opposite semicircular cutouts 4 are represented and designed for the purpose of housing the roller twisted around the end of each bunch of hair.

As has been seen in the original description, and also that many similar supports of different heights depending upon the length of hair being styled, are foreseen, for the support in question, the possibility is foreseen to put one on another or more elements to achieve the right height, hence resolving in an economic and simple way the necessity to have a series of elements of differing size available.

The slots 5 in FIG. 1 provide, for this purpose, the seats for fitting the various stacked elements one on top of the other as shown in FIG. 3.

Other than the advantages already mentioned, for the case of permanent sets, the use of the invention allows the treatment of only the end part of the hair with the appropriate liquid without having to interfere necessarily or dangerously with the hair root or the scalp.

The use of the invention, in addition, allows the preparation of particulary elaborate styles with the help of several accessories described and illustrated in the original document presented.

Having thus described the preferred embodiment of the invention it should be understood that numerous structural modifications and adaptations may be resorted to without departing from the spirit of the invention.

What is claimed is:

1. A support for hair rollers, characterised by an element of plastic material, having the form of a truncated cone, flattened sideways, to provide a continuous side wall of eliptical cross sectional shape, the sides of said element having several ventilation cutouts, the upper edge of said element having a semicircular cutout at each end in diametrically opposed relationship for supporting the ends of an associated hair roller on the top of said element, a pair of oppositely disposed, upstanding tabs on said element upper edge adjacent each of said semicircular cutouts for yieldingly retaining said associated hair roller supported on said cutouts, the lower edge of said element defined by a closed curve of intersection between the sides of said element and that of a sphere whose diameter coincides with the vertical axis of said element to thereby provide a curvilinear contour on said element lower edge conformint to the contour of the crown of a user's head.

2. A support for hair rollers according to claim 1, wherein said element upper edge is provided with a vertically extending slot for accomodating a portion of the side wall of a further element with said elements in vertically stacked relationship.

* * * * *